US006189967B1

(12) United States Patent
Short

(10) Patent No.: US 6,189,967 B1
(45) Date of Patent: Feb. 20, 2001

(54) PORTABLE AIR COOLED SEAT CUSHION

(76) Inventor: Edward J. Short, 9511 S. Millard Ave., Evergreen Park, IL (US) 60805

( * ) Notice: Under 35 U.S.C. 154(b), the term of this patent shall be extended for 0 days.

(21) Appl. No.: 09/428,457

(22) Filed: Oct. 28, 1999

(51) Int. Cl.[7] ..... A47C 7/74

(52) U.S. Cl. ..... 297/180.14; 297/180.11; 297/180.13; 297/180.14

(58) Field of Search ..... 297/180.14, 180.13, 297/180.12, 180.11, 180.1

(56) References Cited

U.S. PATENT DOCUMENTS

| | | | | |
|---|---|---|---|---|
| 1,475,912 | | 11/1923 | William | 297/180.1 X |
| 1,568,471 | | 1/1926 | Roemer . | |
| 1,903,037 | | 3/1933 | Fraver . | |
| 2,022,959 | | 12/1935 | Gordon . | |
| 2,198,532 | | 4/1940 | Gieleghem . | |
| 2,731,542 | * | 1/1956 | Daniels | 297/180.12 X |
| 2,758,532 | | 8/1956 | Awe . | |
| 2,791,956 | | 5/1957 | Guest . | |
| 2,826,135 | | 3/1958 | Benzick . | |
| 2,912,832 | | 11/1959 | Clark . | |
| 2,931,286 | | 4/1960 | Fry, Sr. . | |
| 2,978,972 | | 4/1961 | Hake . | |
| 2,992,604 | | 7/1961 | Trotman et al. . | |
| 3,030,145 | | 4/1962 | Kottemann . | |
| 3,137,523 | | 6/1964 | Karner . | |
| 3,550,523 | | 12/1970 | Segal . | |
| 4,002,108 | | 1/1977 | Drori . | |
| 4,259,896 | | 4/1981 | Hayashi et al. . | |
| 4,335,725 | * | 6/1982 | Geldmacher | 297/180.12 X |
| 4,413,857 | | 11/1983 | Hayashi . | |
| 4,633,061 | * | 12/1986 | Arikawa | 219/202 |
| 4,853,992 | | 8/1989 | Yu . | |
| 4,923,248 | | 5/1990 | Feher . | |
| 4,997,230 | | 3/1991 | Spitalnick . | |
| 5,002,336 | | 3/1991 | Feher . | |
| 5,016,302 | | 5/1991 | Yu | 294/181.13 X |
| 5,370,439 | | 12/1994 | Lowe et al. | 294/180.13 X |
| 5,372,402 | | 12/1994 | Kuo | 297/180.13 |
| 5,382,075 | | 1/1995 | Shih | 297/180.14 |
| 5,385,382 | | 1/1995 | Single, II et al. . | |
| 5,403,065 | * | 4/1995 | Callerio | 297/180.14 X |
| 5,416,935 | | 5/1995 | Nieh . | |
| 5,516,189 | * | 5/1996 | Ligeras | 297/180.12 |
| 5,613,729 | | 3/1997 | Summer, Jr. | 297/180.14 X |
| 5,613,730 | * | 3/1997 | Buie et al. | 297/180.12 |
| 5,626,387 | * | 5/1997 | Yeh | 297/180.14 |
| 5,692,952 | | 12/1997 | Chih-Hung | 297/180.13 X |
| 5,921,858 | * | 7/1999 | Kawai et al. | 297/180.14 X |
| 6,073,998 | * | 6/2000 | Siarkowski et al. | 297/180.12 |

FOREIGN PATENT DOCUMENTS

| | | | | |
|---|---|---|---|---|
| 206151 | * | 12/1986 | (EP) | 297/180.1 |
| WO 84/01885 | * | 5/1984 | (WO) | 297/180.12 |
| WO 84/04221 | * | 10/1984 | (WO) | 297/180.12 |

* cited by examiner

*Primary Examiner*—Peter M. Cuomo
*Assistant Examiner*—Rodney B. White
(74) *Attorney, Agent, or Firm*—Sonnenschein, Nath & Rosenthal

(57) ABSTRACT

A portable air cooled seat cushion is provided in which a fan produces an air stream which is directed to the interior of a portable cushion. The cushion is to be placed on a preformed seat, such as a vehicle seat. The cushion has an air permeable outer covering on a front face thereof which permits air to flow out of the cushion against the legs and back of an occupant of the cushion. The fan is connected to the cushion by a flexible hose, permitting the fan to be located by the occupant in a desirable selected location. Controls are provided for the occupant to adjust the speed of the fan and to be visually apprised of the power level being supplied to the fan.

18 Claims, 1 Drawing Sheet

PORTABLE AIR COOLED SEAT CUSHION

BACKGROUND OF THE INVENTION

The present invention relates to a portable air cooled seat cushion for use with a preformed seat, such as the seat of a vehicle.

Air cooled seats for vehicles have been provided in which a porous seat cushion is supplied with air under pressure to cause the air to flow out through the porous material in the seat cushion to heat or cool a person sitting on the cushion. However, in many instances these seat cushions are quite complicated (for example, see U.S. Pat. Nos. 2,912,832; 5,002,336; 4,923,248), are built into the seat themselves (for example see U.S. Pat. Nos. 1,475,912; 1,568,471; 1,903,037; 2,022,959; 2,826,135; 2,978,972; 4,259,896; 5,385,382; 3,550,523; 5,382,075), require retaining straps to hold the cushions on the vehicle seat, (for example, see U.S. Pat. Nos. 4,413,857; 4,997,230; 2,758,532; 3,030,145; 5,370,439; 5,613,729; 5,692,952), require connection to the vehicle ventilation system (for example, see U.S. Pat. Nos. 3,137,523; 4,997,230; 5,385,382; 5,370,439), have a direct connection to the air moving device permitting transmission of vibration to the seat cushion (for example, see U.S. Pat. Nos. 4,413,857; 2,992,604; 5,692,952), require complicated air flow passages within the seat cushions (for example, see U.S. Pat. Nos. 1,475,912; 2,022,959; 2,826,135; 3,550,523; 4,002,108; 3,550,523; 4,853,992; 5,016,302; 5,372,402; 5,613,729), require the air moving device to be located in a specific area which may cause difficulty to the driver or occupant (for example, see U.S. Pat. Nos. 2,791,956; 2,992,604; 3,030,145; 5,382,075), or have other drawbacks (for example see U.S. Pat. No. 2,931,286) which have prevented such seat cushions from gaining wide commercial acceptance.

Therefore, it would be an advance in the art if there were provided a cushion which overcame these drawbacks.

SUMMARY OF THE INVENTION

The present invention provides for a portable air cooled seat cushion which has a seat portion and a back portion. Both portions have a generally rectangular perimeter, the seat portion having a front, two lateral sides and a rear, while the back portion has a top, two lateral sides and a bottom. The seat and back portions are joined together at least along a portion of the rear perimeter of the seat portion and the bottom perimeter of the back portion. The connection between the seat portion and the back portion is a flexible connection which permits the seat and back to hinge relative to one another so that the back can hinge down onto the seat or can be moved upright to 90° relative to the seat.

The seat and back portions each have an air permeable covering on a front side, an air impermeable covering on a back side, and a relatively open, porous filler so as to form air passages within the seat portion and the back portion. A standard, readily available seat cushion can be utilized which has a series of coiled wires inside of a woven vinyl covering. Thus, the wire coils hold the front and back faces of the seat and back portions apart from one another to allow for air to flow through the interior, and the woven vinyl covering is porous to permit air to flow therethrough at the front face.

The present air cooled seat cushion may have at least part of the joined portion of the perimeter being open between the back portion and the seat portion in order to permit a flow of air between the seat portion and the back portion. Alternatively, there may be no opening or communication between the back portion and the seat portion.

A flow of air is directed into the seat portion through the use of an electric motor powered air fan which can be powered from the vehicle 12 volt system through a power cord. The fan draws in ambient air from the passenger compartment of the vehicle since air conditioned air directly from the vehicle air conditioning system would be too cold for long term comfort for the occupant of the seat cushion. An adapter member is secured to an open side seam of the seat portion to allow a flexible hose to be connected between the air fan and the adapter, such that air flow from the fan will be directed into the interior of the seat portion to flow out of the air permeable covering thereof, and optionally through the interior up into the back portion to flow out of the air permeable cover thereof as well.

An electrical control component may be connected in the power cord to permit a user to control a selected flow of electrical current to the air fan in a range from 0 to a pre-determined maximum current. Also, an indicator light may be connected in series with the electrical control component to provide a visual indication to a user of the level of electrical current being supplied to the air fan. Further, a fuse may be provided to protect the air fan against a current spike.

DETAILED DESCRIPTION OF THE PREFERRED EMBODIMENTS

Figures 1, 2, 3:
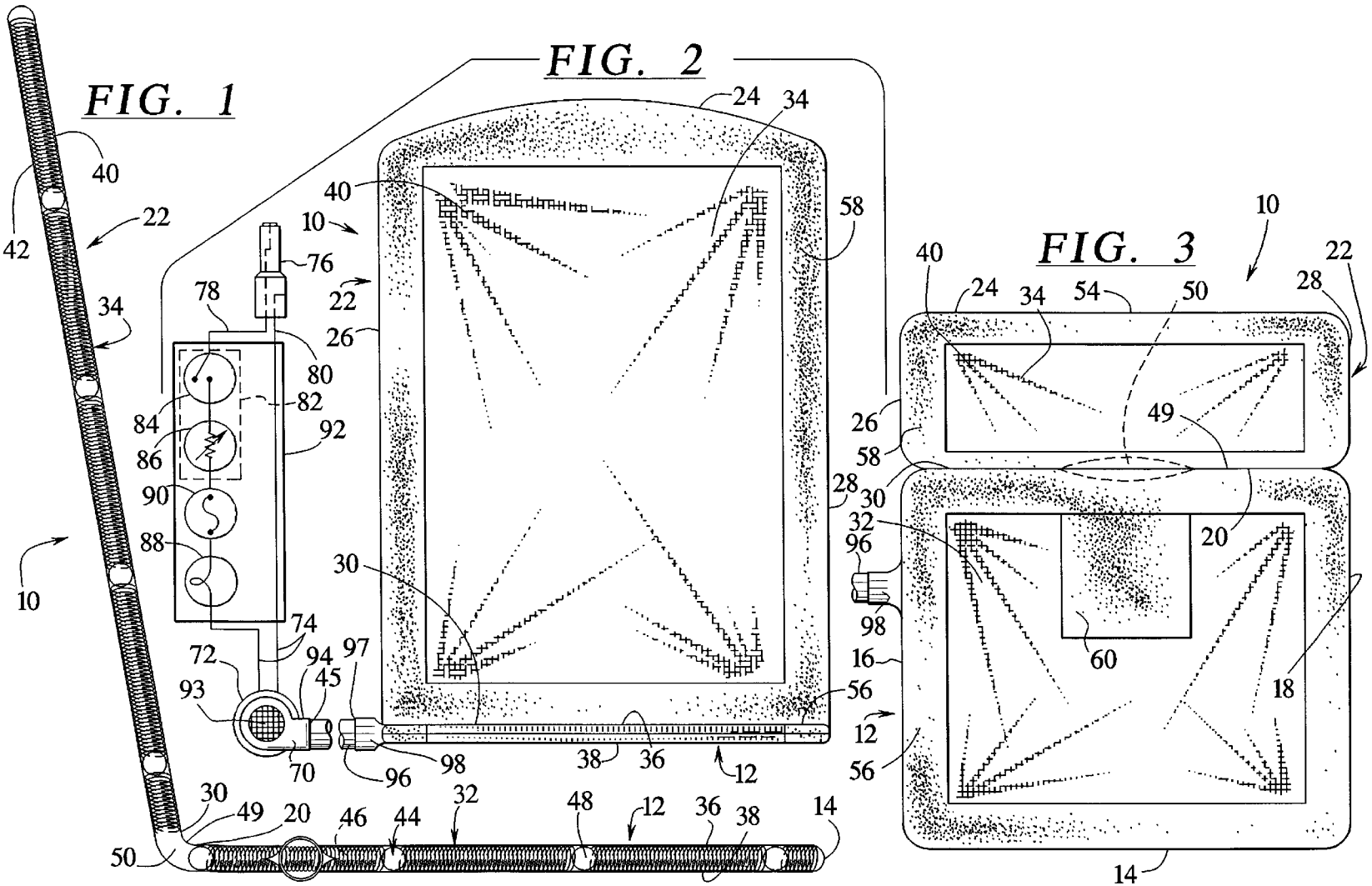
FIG. 1 is a schematic side elevational view, with the interior exposed, of a portable air cooled seat embodying the principles of the present invention.
FIG. 2 is a front elevational view of the seat of FIG. 1 and a schematic illustration of the electrical controls and air flow system.
FIG. 3 is a top elevational view of the seat of FIG. 1.

FIGS. 1–3 illustrate a portable air cooled seat cushion generally at 10 which includes a seat portion 12 having a generally rectangular perimeter including a front 14, two lateral sides 16, 18 and a rear 20. The seat cushion 10 also includes a back portion 22 which also has a generally rectangular perimeter including a top 24, two lateral sides 26, 28 and a bottom 30. The seat 12 and back 22 portions each have a covering 32, 34 respectively. The covering 32 of the seat portion 12 has a front or top face 36 which is air permeable and a rear or bottom face 38 which is air impermeable. The covering 34 of the back portion 22 has a front 40 face which is air permeable and a rear 42 face which is air impermeable. An interior 44 of the seat portion 12 and back portion 22 has a relatively open, porous filler 46 so as to form open air passages 48 within the seat portion 12 and the back portion 22. A typical seat cushion, which is readily available and can be adapted for use with the present invention utilizes a series of wire coils as the relatively open, porous filler 46 which allows for virtually unrestricted air flow through the interior of the seat portion 12 and back portion 22. The seat portion 12 and the back portion 22 are joined at 49 along at least a portion of the rear perimeter 20 of the seat portion and the bottom perimeter 30 of the back portion in a flexible and hingeable manner. Optionally, a portion of the joined portion 49 of the perimeters may be open to the interior, as at 50, to permit a flow of air between the interior of the seat portion 12 and the interior of the back portion 22.

A typical, portable and readily available seat cushion which can be utilized with the present invention has the front face 36, 40 of the covering 32, 34 made of a woven vinyl fabric in which the interstices between the individual vinyl strips are open so as to permit a flow of air therethrough. The rear faces 38, 42 are made of, or covered by, a solid, air impermeable covering. The interstices in the front faces are sufficiently small so as to not let all of the air flow out of the interior immediately, but rather cause the air to be distributed throughout the interior of the seat 12 and back portions 22 to flow out around the upper legs and back of the seat cushion occupant. A seam 52 generally extends around the non-joined perimeter of the seat portion 12 and a seam 54 extends generally around the non-joined perimeter of the back portion 22. If desired, an air impermeable material, such as an adhesive backed tape 56, may be applied around the non-joined perimeter to prevent air from escaping through the horizontal sides 16, 18 and front 14 of the seat portion 12 and to cause more of the air to flow up through the exposed front face 36 where user will be seated. Similarly, the same air impermeable material 58 may be applied to the non-joined perimeter of the back portion 22 to prevent an air flow through the sides 26, 28 and top 24 of the back portion 22, to cause the air to flow out through the exposed front face 40 of the covering 34.

An air impermeable patch 60 may be selectively secured to the exposed face 36 of the seat covering 32, typically in an area near the joinder of the seat portion 12 with the back portion 22 to prevent discomfort to a user of the seat cushion, if necessary, particularly for those users who suffer from hemorrhoids. The patch 60 could be an adhesive backed sheet of air impermeable material which could be selectively placed, and relatively permanently secured to the seat portion 12 by a user. Alternatively, the patch 60 could be permanently applied while the seat portion 12 is being constructed. A further option would be to have the patch readily removable, such as by attachment by hook and loop fasteners, such as sold under the brand name Velcro®.

As illustrated in FIG. 2, in order to provide a flow of air to the interior of the seat 10 a fan 70 is provided which is driven by an electric motor 72. The electric motor is supplied with current through a two wire cable 74 which terminates in a plug 76 of the type which may be received in a 12 volt vehicle outlet such as a cigarette lighter. The power cord 74 has a positive wire 78 and a negative wire 80. Located in the positive wire 78 is an electrical control component 82 which, in a preferred embodiment, includes a switch 84 and a rheostat or potenidometer 86 through which the user may control a selected flow of electrical current to the air fan 70 in a range from 0 to a predetermined maximum current for full speed operation of the air fan. Although the electrical control component 82 may include only an off/on switch 84, it is preferred that a rheostat 86 also be provided, or a multi-position switch, such that the user can select a plurality of current levels to be supplied to the air fan in addition to no current at all. The rheostat 86 could comprise a step switch having a series of detents or it could be a continuously adjustable rotary rheostat or poteniometer. Those skilled in the art will recognize that there are a variety of electrical control components which could provide this function.

The positive wire 78 also includes an indicator light 88 therein, such as an incandescent bulb or an LED, which will give a visual indication to the user of the level of electrical current being supplied to the air fan 70. Further, the positive wire 78 preferably includes a fuse 90 to provide protection to the air fan against a current spike. All of the electrical components can be incorporated into a control box 92 mounted to a housing of the air fan or motor.

Alternatively, the control box 92 may be secured to the adapter 98 or the second end 97 of the hose 96 so that it will always be closely available to the occupant of the seat cushion 10.

The air fan 70 has an air inlet 93 which preferably has a screened or otherwise protected opening to prevent a user's fingers from entering the rotating blade area of the fan. The air fan 70 also has an air outlet 94, to which is connected a first end 95 of a flexible hose 96. Typically the hose would have a diameter of about 1½ inches but could be somewhat larger or smaller than that. A second end 97 of the hose 96 is removably received in an adapter member 98 which is secured to the seat portion 12. Preferably the seam 52 along the side 16 is opened and the adapter member 98 is sealed to the side in an air impermeable manner, such as by an air impermeable adhesive backed tape, to provide a connection point for the hose 96 to deliver pressurized air to the interior of the seat portion 12.

The hose 96 has a length of about 1 to 3 feet and preferably is flexible to prevent the transmission of vibration from the air fan to the seat cushion. For example, a flexible and corrugated plastic hose could be used. The length of the hose between the seat portion and the air fan 70 permits the air fan to be placed within the passenger compartment of a vehicle in a convenient location and to avoid interference with the driver's or occupant's feet or other obstacles within the compartment. The second end 97 of the hose 96 can be removably secured to the adapter 98 such that the user could selectively detach the hose 96 from the adapter 98, such as for storage of the seat 10. Also, the connection between the hose 96 and the adapter 98 preferably is a swivel connection in order to accommodate movement of the hose and placement of the air fan 70 at a desired selected location in the passenger compartment of the vehicle, as best suits the user of the seat cushion 10. The swivel connection will help avoid the formation of kinks in the hose 96 as it is moved around.

Since the air cooled seat cushion 10 does not require the use of straps or other attaching devices to hold the air cooled seat cushion 10 on a vehicle or other preformed seat, the air cooled seat cushion can easily be put into place, or removed for storage or transfer to another vehicle or preformed seat, without extra time and effort necessary for assembly or disassembly purposes.

As is apparent from the foregoing specification, the invention is susceptible of being embodied with various alterations and modifications which may differ particularly from those that have been described in the preceding specification and description. For example, although the invention has been generally described as being useful in connection with the preformed seats of a vehicle, the portable air cooled seat cushion embodying the invention could be used in conjunction with other types of preformed seats, including couches and chairs. The power supply for the air flow, therefore, may differ from the vehicle plug 12 volt system, and may include 120 volt AC domestic power supply. Other variations to the specific embodiment disclosed herein will be apparent to a person skilled in the art. It should be understood that I wish to embody within the scope of the patent warranted hereon all such modifications as reasonably and properly come within the scope of my contribution to the art.

I claim as my invention:

1. A portable air cooled seat cushion comprising:

a cushion member for selective placement onto a preformed seat, said cushion member having a seat portion, with a perimeter defining a front, two lateral sides and a rear, and a back portion, with a perimeter defining a top, two lateral sides and a bottom, said seat and back portions joined along at least a portion of said rear perimeter of said seat portion and said bottom perimeter of said back portion;

said seat and back portions each having an air permeable covering on a front face thereof and a relatively open, porous filler so as to form open air passages within said seat portion and said back portion;

at least part of said joined portion of said perimeters being open between said back portion and said seat portion to permit a flow of air between said seat portion and said back portion;

an air impermeable covering secured along at least a portion of said perimeter of said seat portion and said back portion;

an air impermeable patch located on said seat portion to form a covered area, near said joined portion between said seat portion and said back portion, to block a flow of air out of said seat portion in said covered area;

a single opening in said perimeter of said seat portion along one of said lateral sides of said seat portion;

an adapter member inserted into said seat portion, and secured therein at said opening;

said adapter member having a hollow air passage therethrough;

a flexible air hose connected at one end only to said hollow air passage of said adapter member;

an electric motor powered air fan having an air outlet connected only to a second end of said hose, such that an air stream created by said air fan will be directed by said air fan exclusively through said hose and diverter member into said seat portion;

an electrical plug, adapted to be received in a 12-volt vehicle electrical outlet, connected by a positive wire and a negative wire to said air fan for providing electrical current to said air fan;

an electrical control component connected in said positive wire between said electrical plug and said air fan to permit a user to control a selected flow of electrical current to said air fan in a range from zero to a predetermined maximum current;

an indicator light connected in series with said electrical control component in said positive wire to provide a visual indication to a user of the level of electrical current being supplied to said air fan; and a fuse connected in series in said positive wire to provide protection to said air fan against a current spike.

2. A portable air cooled seat cushion according to claim 1, wherein said seat portion and said back portion coverings are air impermeable on a back side thereof.

3. A portable air cooled seat cushion according to claim 1, wherein said seat portion and said back portion front face coverings are made of a woven vinyl material.

4. A portable air cooled seat cushion according to claim 1, wherein said air impermeable covering extends along said of said seat portion and said back portion.

5. A portable air cooled seat cushion according to claim 1, wherein said air impermeable covering comprises a tape material.

6. A portable air cooled seat cushion according to claim 1, wherein said patch is removably applied to said seat portion such that a user may easily move said patch to a desired location and secure it in said location.

7. A portable air cooled seat cushion according to claim 1, wherein said patch is secured by an adhesive.

8. A portable air cooled seat cushion according to claim 1, wherein said diverter member is secured in said opening by a tape material.

9. A portable air cooled seat cushion according to claim 1, wherein said flexible air hose has a length of between one and three feet.

10. A portable air cooled seat cushion according to claim 1, wherein said electrical control component, said indicator light and said fuse are contained in a control box mounted to one of said air fan, said adapter member and said hose.

11. A portable air cooled seat cushion according to claim 1, wherein said indicator light is an LED.

12. A portable air cooled seat cushion according to claim 1, wherein said electrical control component comprises a switch.

13. A portable air cooled seat cushion according to claim 1, wherein said electrical control component comprises a rheostat.

14. A portable air cooled seat cushion according to claim 13, wherein said rheostat comprises a stepped switch having a series of detents.

15. A portable air cooled seat cushion according to claim 13, wherein said rheostat is continuously adjustable.

16. A portable air cooled seat cushion according to claim 1, wherein said electrical control component comprises a switch and a rheostat.

17. A portable air cooled seat cushion comprising:

a cushion member for selective placement onto a preformed seat, said cushion member having a seat portion, with a perimeter defining a front, two lateral sides and a rear, and a back portion, with a perimeter defining a top, two lateral sides and a bottom, said seat and back portions joined along at least a portion of said rear perimeter of said seat portion and said bottom perimeter of said back portion;

said seat and back portions each having an air permeable covering on a front face thereof made of a woven vinyl material and a relatively open, porous filler so as to form open air passages within said seat portion and said back portion;

at least a part of said joined portion of said perimeters being open between said back portion and said seat portion to permit a flow of air between said seat portion and said back portion;

an air impermeable covering secured along said perimeters of said seat portion and said back portion;

an air impermeable patch located on said seat portion to form a covered area, near said joined portion between said seat portion and said back portion, to block a flow of air out of said seat portion in said covered area;

said patch being removably applied to said seat portion such that a user may easily move said patch to a desired location and secure it in said location;

a single opening in said perimeter of said seat portion along one of said lateral sides of said seat portion;

an adapter member inserted into said seat portion, and secured therein at said opening;

said adapter member having a hollow air passage therethrough;

a flexible air hose having a length of between one and three feet connected at one end only to said hollow air passage of said adapter member;

an electric motor powered air fan having an outlet connected only to a second end of said hose, such that an air stream created by said fan will be directed by said fan exclusively through said hose and adapter member into said seat portion;

an electrical plug, adapted to be received in a 12-volt vehicle electrical outlet, connected by a positive wire and a negative wire to said air fan for providing electrical current to said air fan;

an electrical control component connected in said positive wire between said electrical plug and said air fan to permit a user to control a selected flow of electrical current to said air fan in a range from zero to a predetermined maximum current;

said electrical control component being arranged to permit a selection of a plurality of current levels in addition to no current to said air fan;

an indicator light in the form of an LED connected in series with said electrical control component in said positive wire to provide a visual indication to a user of the level of electrical current being supplied to said air fan; and a fuse connected in series in said positive wire to provide protection to said air fan against a current spike;

said electrical control component, said indicator light and said fuse being contained in a control box mounted to one of said air fan, said adapter member and said hose.

18. A portable air cooled seat cushion comprising:

a cushion member for selective placement onto a preformed seat, said cushion member having a seat portion, with a perimeter defining a front, two lateral sides and a rear, and a back portion, with a perimeter defining a top, two lateral sides and a bottom, said seat and back portions joined along at least a portion of said rear perimeter of said seat portion and said bottom perimeter of said back portion;

said seat and back portions each having an air permeable covering on a front face thereof and a relatively open, porous filler so as to form open air passages within said seat portion and said back portion;

an air impermeable patch located on said seat portion to form a covered area, near said joined portion between said seat portion and said back portion, to block a flow of air out of said seat portion in said covered area;

an opening in said perimeter of said seat portion along one of said lateral sides of said seat portion;

an adapter member inserted into said seat portion, and secured therein at said opening;

said adapter member having a hollow air passage therethrough;

a flexible air hose connected at one end to said hollow air passage of said adapter member;

an electric motor powered air fan having an outlet connected to a second end of said hose, such that an air stream created by said fan will be directed by said fan through said hose and adapter member into said seat portion;

an electrical plug connectable by a pair of wires to a source of electrical current and to said air fan for providing electrical current to said air fan;

an electrical control component connected in one of said wires between said electrical plug and said air fan to permit a user to control a selected flow of electrical current to said air fan in a range from zero to a predetermined maximum current;

an indicator light connected in one of said wires to provide a visual indication to a user of the level of electrical current being supplied to said air fan; and a fuse connected in one of said wires to provide protection to said air fan against a current spike.

* * * * *